US005558079A

United States Patent [19]

Goelz

[11] Patent Number: 5,558,079

[45] Date of Patent: Sep. 24, 1996

[54] TRASH INCINERATOR

[75] Inventor: James W. Goelz, Wheatland, Wyo.

[73] Assignee: Diamond G Progressive Enterprises, Inc., Wheatland, Wyo.

[21] Appl. No.: 499,780

[22] Filed: Jul. 7, 1995

[51] Int. Cl.[6] ..... F23G 5/00

[52] U.S. Cl. ..... 126/224; 110/119; 110/214; 110/217; 110/248; 110/249

[58] Field of Search ..... 126/224; 110/119–121, 110/210, 214, 216, 217, 235, 248, 249

[56] References Cited

U.S. PATENT DOCUMENTS

| | | | |
|---|---|---|---|
| 1,433,438 | 10/1922 | Watson | 110/235 |
| 1,565,042 | 12/1925 | Arrowood | 110/235 |
| 2,748,728 | 6/1956 | Triggs | 110/214 |
| 2,859,716 | 11/1958 | Slaughter | 110/214 |
| 2,860,626 | 11/1958 | Hebert | 110/235 |
| 3,881,870 | 5/1975 | Hatfield | 110/119 |
| 4,452,152 | 6/1984 | John et al. | 110/214 |

*Primary Examiner*—Carroll B. Dority
*Attorney, Agent, or Firm*—Dean Edmundson

[57] ABSTRACT

An inexpensive trash incinerator having a primary burn chamber and an after burner which includes a spark arrestor. The after burner is a stack which rests on top of the primary burn chamber and it includes an opening in its lower end for admitting fresh air into the after burner.

8 Claims, 7 Drawing Sheets

TRASH INCINERATOR

FIELD OF THE INVENTION

This invention relates to incinerators. More particularly, this invention relates to trash incinerators, especially those of the type which are inexpensive and which can be used by the ordinary consumer for burning household trash.

BACKGROUND OF THE INVENTION

Incinerators of various types have been used for burning a variety of materials. Some of such units require a separate fuel source such as propane or natural gas, and such units are accordingly expensive to use.

Some people have used a simple open-top burning barrel for burning household trash. The use of such barrels has been prohibited in most areas because they do not burn trash cleanly or thoroughly. Consequently, they produce significant smoke. They can also produce burning embers which present a safety hazard. Furthermore, burning barrels typically rust or burn through the walls in a relatively short time, thereby shortening the useful life of the barrel.

The trash incinerator of the invention replaces burning barrels and open fires for burning household generated waste in rural areas, where allowed by law. A main purpose is to reduce the chances of starting unintended fires. Another purpose is to reduce exhaust emissions into the atmosphere and, because of a very complete burn, reduce impact on landfill dumps.

The use of the incinerator also encourages recycling because cans, glass, aluminum foil and most plastics are separated out before burning.

There has not heretofore been described a trash incinerator having the advantages provided by the apparatus of the present invention.

SUMMARY OF THE INVENTION

In accordance with the present invention there is provided a trash incinerator which is very effective for burning common household trash in a safe and efficient manner. In a preferred embodiment the apparatus comprises:

(a) a body member which comprises the main burn chamber;

(b) a vertical tubular stack member extending upwardly from the top of the body member; the stack member serves as an after burner for any combustible material or gases which exit from the burn chamber into the stack member; and (c) a spark arrestor in the stack member for preventing sparks or burning material from escaping from the top of the stack member.

The trash incinerator is very effective for burning household trash without having to add supplementary fuel to the incinerator. The body member includes an opening (preferably in the top) with a closeable lid to enable trash to be loaded or added to the burn chamber.

The stack member is preferably of a square or rectangular cross-section and it includes an opening at its lower end to admit air directly into the stack. Preferably the volume ratio of inlet air to exhaust gases in the stack is about 1:5 to 1:6.5.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
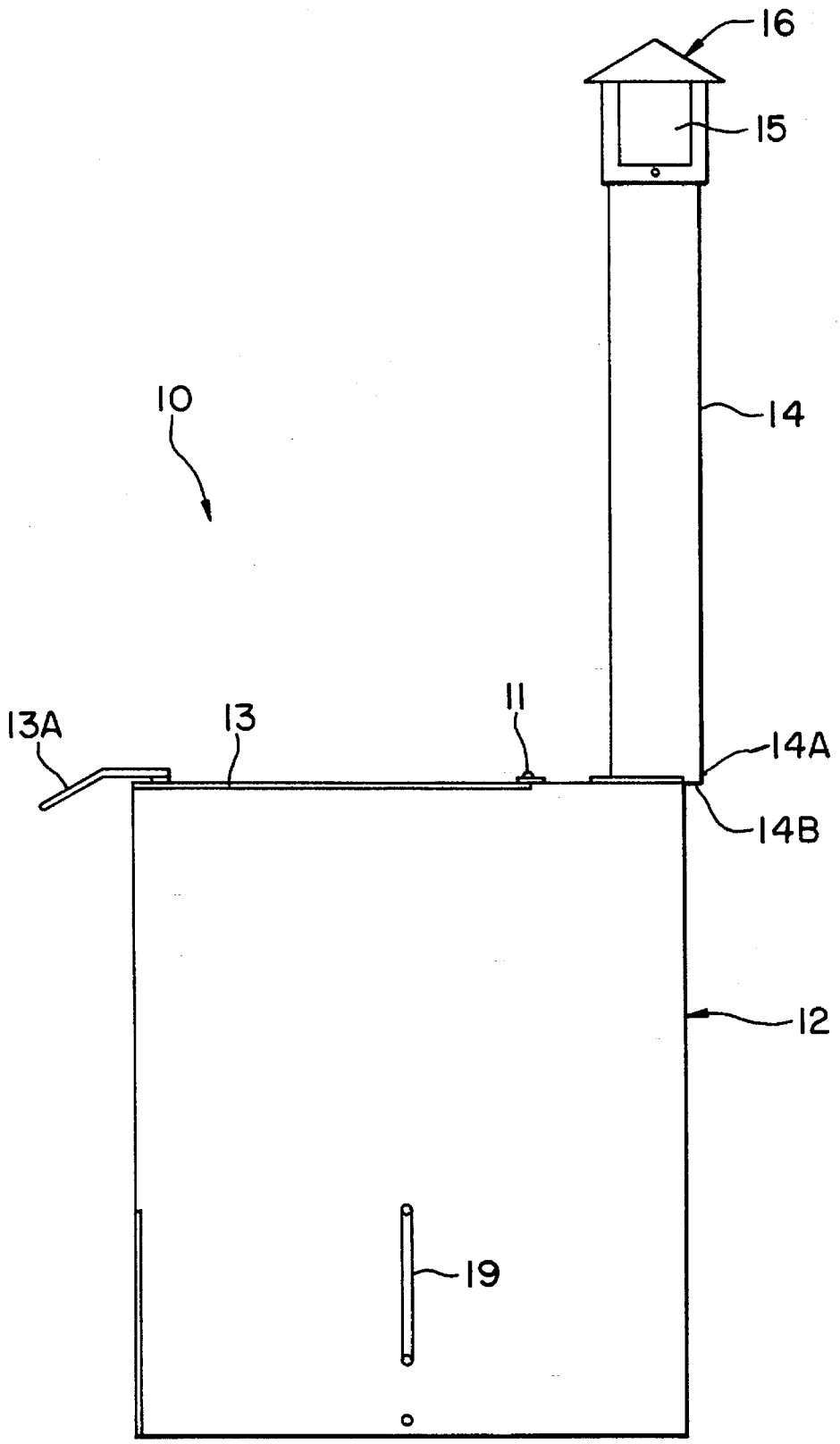
FIG. 1 is a side elevational view of a preferred embodiment of trash incinerator of the invention.
Figure 2:
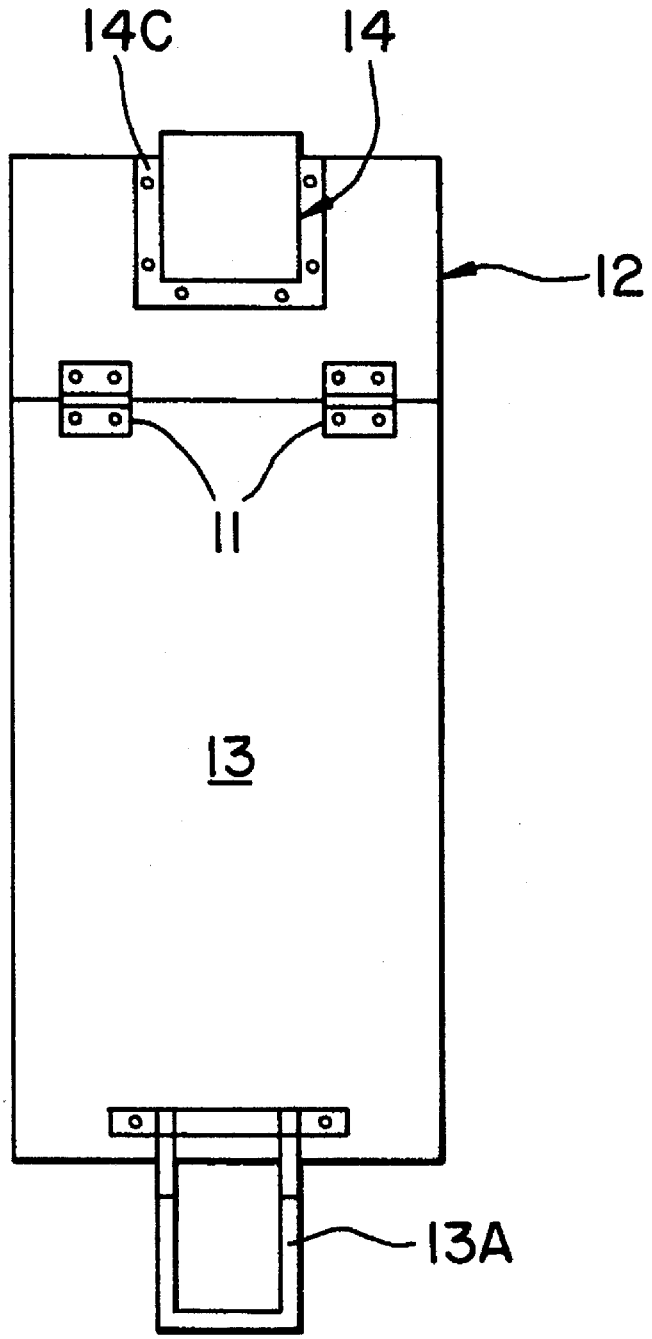
FIG. 2 is a top view of the incinerator of FIG. 1.
Figure 3:
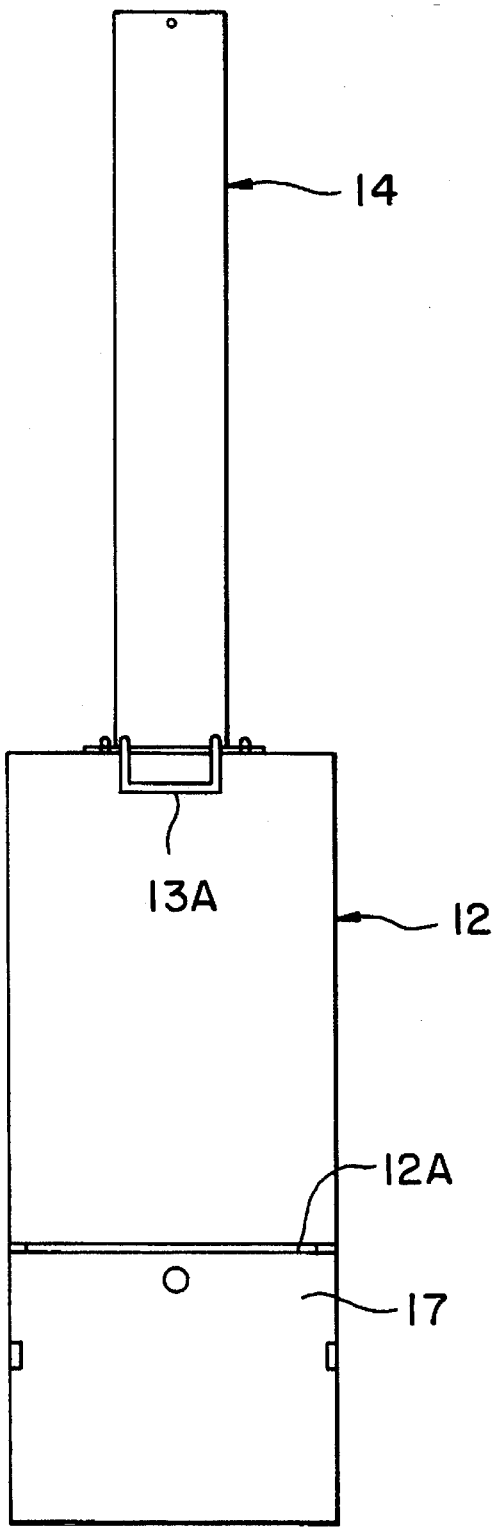
FIG. 3 is a front elevational view of the incinerator of FIG. 1.

In the drawings there is shown a preferred embodiment of trash incinerator 10 of the invention comprising a body member 12 (which includes the burn chamber) and an upwardly extending stack member 14. The stack member is a tubular member having an internal bore or passageway leading from the lower end to its upper end. The upper end of the stack is open to the atmosphere. A four-sided, pyramid-shaped cap 16 may be secured to the upper end of the stack (with an opening 15 between the cap and the upper end of the stack) to induce a draft in the stack member (with wind as low as three miles per hour) to draw exhaust gases upwardly through the stack.

The body member or enclosure 12 includes an openable lid 13 with handle 13A at one end (the opposite end of the lid being hinged with hinges 11 to the top of the body member). Trash or other material to be burned in the incinerator is added to the burn chamber by simply opening the lid.

The body member includes a generally-horizontal grate 18 which separates the burn chamber from an ash pit below the grate in body member 12. A door 17 at the front of the body 12 provides access to the ash pit for cleaning purposes. A shaker handle 19 is connected to a shaker disposed immediately beneath the grate for enabling the grate to be shaken or jostled to cause ashes on the grate to fall through to the ash pit. Generally the volume of the burn chamber is about 2.5 to 3 times the volume of the ash pit.

The front wall of the body member 12 includes an elongated horizontal slotted aperture 12A for admitting fresh air into the burn chamber. The ratio of inlet air volume to exhaust gas volume is preferably about 1:3.5 to 1:4.5. Even more preferably the ratio is about 1:4.

The lower end of the stack member 14 rests on top of and is secured to the body member with mounting flange 14C. The lower end of the stack member communicates with the burn chamber or interior of the body member to enable exhaust gases to exit the body member. By virtue of a slight offset between the lower end 14A of the stack member and the top of the body member 12, an opening 14B is defined at the lower end of the stack member for the purpose of admitting fresh air into the stack. The opening 14B may be, for example, about one inch wide and as long as the full width of the stack member (e..g, six inches).

Preferably the volume ratio of fresh air inlet to exhaust gases is about 1:5 to 1:6.5. More preferably the volume ratio is about 1:5.9. The fresh air entering the stack enables the stack member to function as an after burner (i.e., for burning any combustible material in the exhaust gases). The fresh air will be drawn into the lower end of the stack naturally as the exhaust gases rise in the stack.

Figure 4:
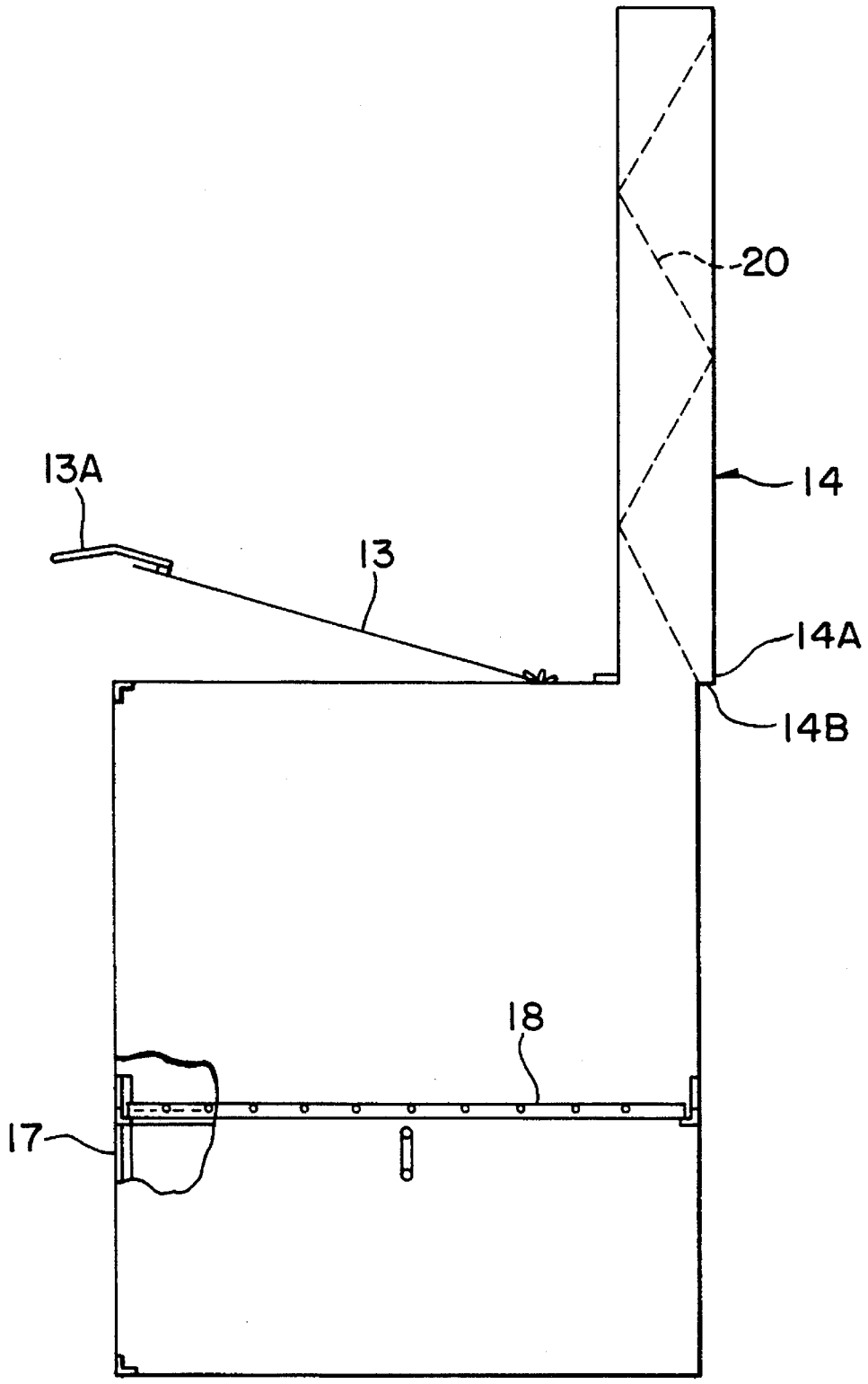
FIG. 4 is a side elevational view, partially cut-away, of the incinerator of FIG. 1.
Figure 5:
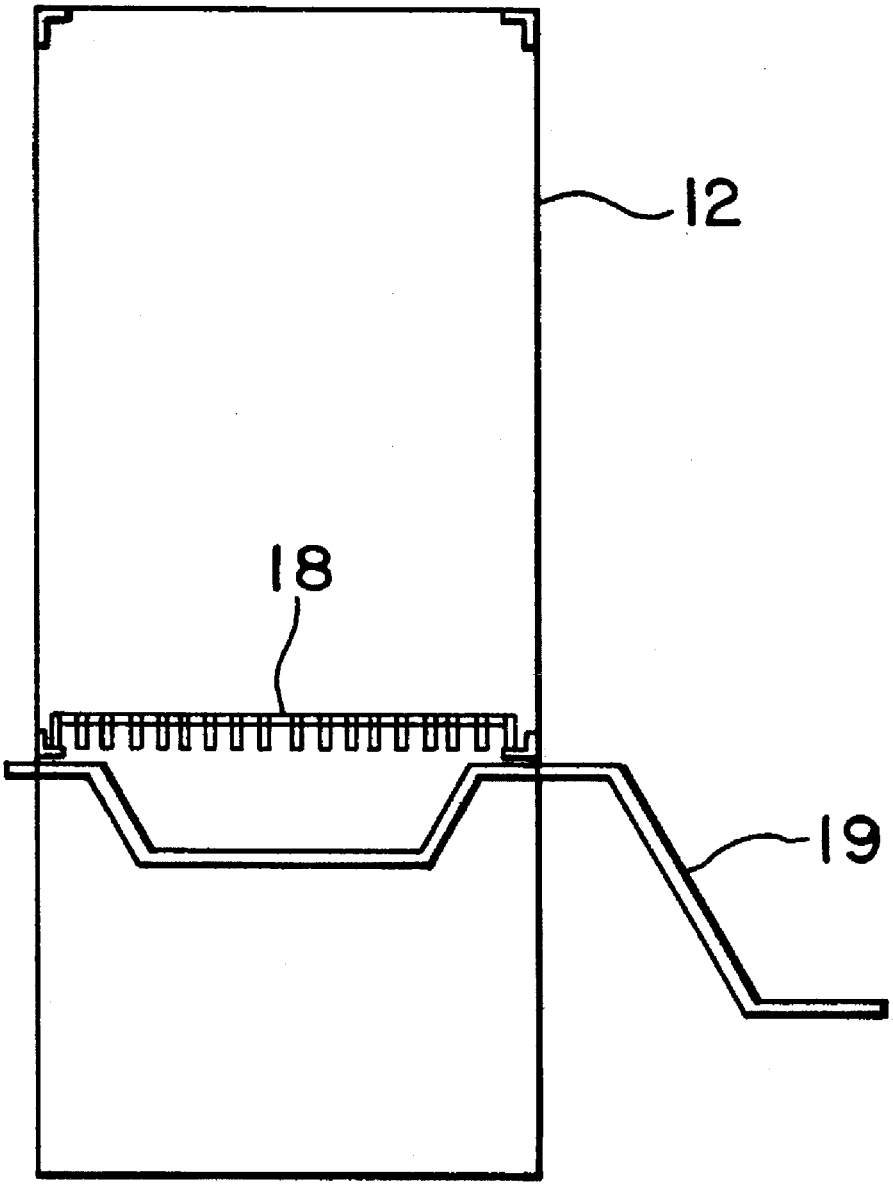
FIG. 5 is a front elevational view of the burn chamber of FIG. 1 cut away to show the grate.
Figure 6:
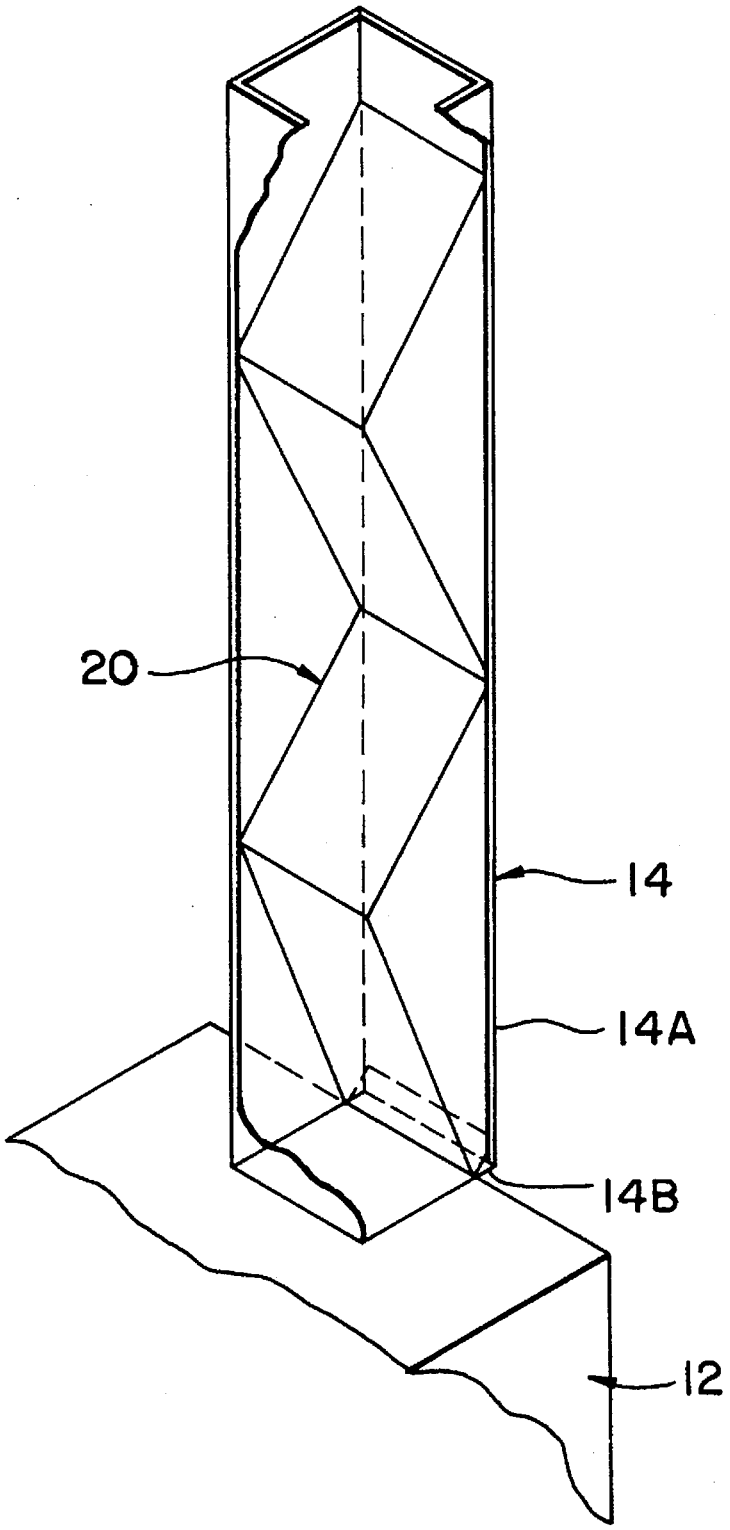
FIG. 6 is a cut-away perspective view showing the spark arrestor in the stack member.

Positioned inside the stack member is a spark arrestor 20 to prevent sparks or burning material from exiting out the top of the stack member. Preferably the spark arrestor is composed of a single length of expanded metal (or metal screen) which is bent or folded as shown in FIGS. 4 and 6 so as to extend across the width of the stack member and also throughout nearly the full length of the stack. Preferably the openings in the spark arrestor are about 0.5 inch at their widest point. Four levels of spark arrestor (as shown in the drawings) are adequate, although more levels may be provided if desired.

Figure 7:
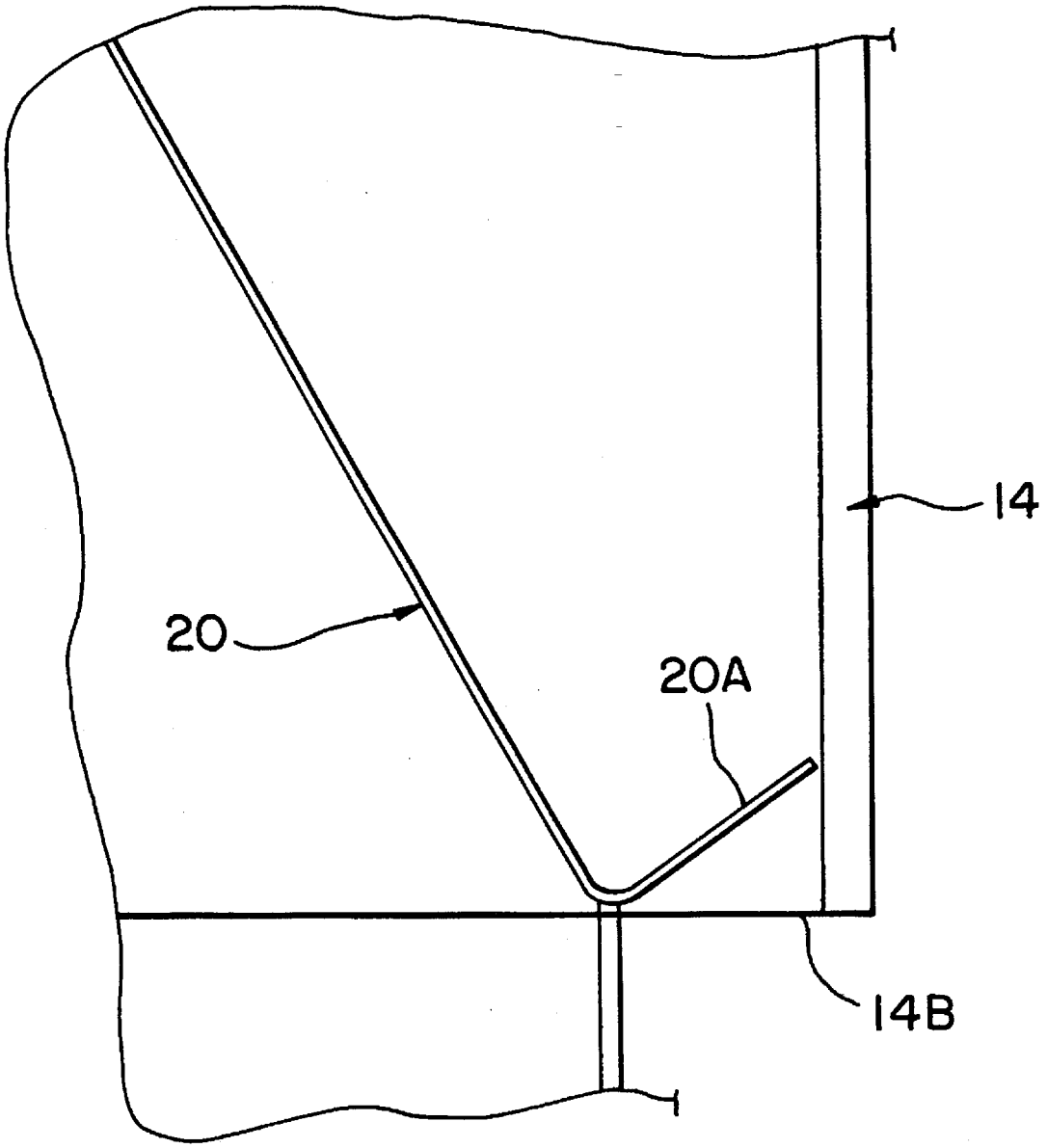
FIG. 7 is a cut away elevational view showing the lower end of the spark arrestor.

The lower end 20A of the spark arrestor is preferably bent upwardly at an angle (as shown in FIG. 7). This prevents the spark arrestor from falling downwardly into the burn chamber.

It is not necessary for the spark arrestor to be secured or fastened to the walls of the stack member. Its own weight is sufficient to hold it in the stack. Also, if it is necessary to replace the spark arrestor, it can be simply lifted out through the open top end of the stack, and a new spark arrestor can then be inserted into the stack via the open top end of the stack.

The stack member is preferably square or rectangular in cross-section so that a spark arrestor screen can easily be used which has straight and parallel side edges. Other cross-sectional configurations for the stack (e.g., circular, oval, hexagonal, etc.) can be used but then the shape of the spark arrestor becomes more complicated.

The stack member could be composed of insulated pipe or multi-walled pipe, if desired, but that is not required. The height of the stack member may vary, but a height of at least about 40 inches is preferred. Typically the stack is composed of A36 steel.

The body member should be composed of Cor-Ten low alloy steel (grade A), which is commercially available from USX (U.S. Steel), for best long-term life of the body member.

The dimensions of the body member and the stack may vary, as desired. Typically the body member has a width of about 18 inches, a depth of about 36 inches, and a height of about 42 inches. The stack preferably has a height of about 40 inches and a diameter of about 6 inches by 6 inches (square tubing).

Other variants are possible without departing from the scope of this invention. For example, it is possible to include a fan of any make or suitable design (e.g., squirrel cage or conventional bladed fan) for the purpose of forcing fresh air into the lower end of the stack member to induce draft in the stack member. The motor driving the fan should be variable speed so that the speed can be set for the lowest visible emissions from the stack. The motor may have a manual switch or it may be controlled by a thermostatic switch affixed to the incinerator body member and set at, for example, 200° F. to turn on and 150° F. to shut off. The use of such a fan ensures maximum efficiency of the incinerator on calm days.

What is claimed is:

1. A trash incinerator comprising:

(a) a body including a burn chamber;

(b) a vertical tubular stack member extending upwardly from said body member; wherein said stack member communicates with said burn chamber to enable combustion gases to exit said burn chamber into said stack member; wherein said stack member includes an opening for fresh air to enter said stack member; wherein said stack member has four side walls; and wherein opposing side walls are parallel to each other; and (c) spark arrestor means in said stack member for preventing sparks from escaping out of said stack member; wherein said spark arrestor comprises an elongated unitary screen having openings therethrough; and wherein said screen is folded to provide a plurality of sections which extend between opposing side walls.

2. A trash incinerator in accordance with claim 1, wherein said stack member has a square cross-section.

3. A trash incinerator in accordance with claim 1, wherein said stack member includes a lower end which is secured to said body member such that said opening for fresh air is provided between said body member and said lower end of said stack member.

4. A trash incinerator in accordance with claim 1, wherein said body member includes a hinged lid.

5. A trash incinerator in accordance with claim 1, wherein said body member includes an air inlet aperture.

6. A trash incinerator in accordance with claim 1, wherein said body member further includes an ash pit and a grate separating said burn chamber and said ash pit.

7. A trash incinerator in accordance with claim 1, wherein said body member comprises alloy steel.

8. A trash incinerator in accordance with claim 3, wherein said opening for fresh air comprises a slotted aperture between said lower end of said stack member and said body member.

* * * * *